US005095668A

United States Patent [19]

O'Brien et al.

[11] Patent Number: 5,095,668

[45] Date of Patent: Mar. 17, 1992

[54] NEWEL POST FASTENING SYSTEM

[76] Inventors: Daniel K. O'Brien, 14737 Echo Way, Apple Valley, Minn. 55124; Jeffery O. Oland, 7120 - 1st Ave., S., Richfield, Minn. 55423

[21] Appl. No.: 605,407

[22] Filed: Oct. 30, 1990

[51] Int. Cl.[5] ..... E04H 17/14

[52] U.S. Cl. ..... 52/184; 256/65; 256/22; 256/59

[58] Field of Search ..... 256/21, 22, 59, 65; 52/184; 403/8, 406.1

[56] References Cited

U.S. PATENT DOCUMENTS

| | | | |
|---|---|---|---|
| 790,027 | 5/1905 | Brodt | 403/8 |
| 4,295,638 | 10/1981 | Eldeen . | |
| 4,344,604 | 8/1982 | Basey | 256/65 |
| 4,352,485 | 10/1982 | Basey | 256/65 |
| 4,367,864 | 1/1983 | Eldeen . | |
| 4,383,676 | 5/1983 | Souza, Jr. | 256/22 |
| 4,587,788 | 5/1986 | Bielicki . | |

*Primary Examiner*—David A. Scherbel
*Assistant Examiner*—Wynn Wood
*Attorney, Agent, or Firm*—John W. Bunch

[57] ABSTRACT

An apparatus for installing a newel post in a railing comprises a straight, double-ended bolt (12), the lower end of which includes coarse lag threads (14) by which it is screwed into a hole drilled into the underlying floor. The upper end of the bolt (12) includes screw threads (16) which extend through intersecting longitudinal and transverse holes (24, 40) drilled in the bottom end and side of the newel post (22) for receiving a nut and washer (18, 20) by which the newel post is tightened down. The transverse hole (40) is preferably closed with a plug 42.

15 Claims, 1 Drawing Sheet

NEWEL POST FASTENING SYSTEM

TECHNICAL FIELD

The present invention relates generally to a fastening system. More particularly, this invention concerns an improved method and apparatus for securing newel posts in the construction of railings along balconies, stair treads, landings and the like.

BACKGROUND ART

During home construction, railings are usually provided along stair treads, landings, balconies and the like. One end of the railing is typically secured to a wall while the other end is secured to a newel post, which is usually located away from a wall and anchored primarily only at its lower end. Because such newel posts are pulled and pushed during use, they can become loose and must be properly installed and secured. In the past, the installation of such newel posts has been time-consuming and costly because special skills and tools and additional finishing work was required. Additional bracing or reinforcement also was sometimes required, depending upon the particular installation.

Various fastening systems incorporating plates, braces and screws have been available for this purpose. For example, U.S. Pat. Nos. 4,295,638 and 4,367,864 to Eldeen, and U.S. Pat. No. 4,587,788 to Bielichi are representative of the prior art in this regard. These devices offer some improvement in installation time, but are still overly complicated and suffer from various other limitations.

A need has thus arisen for a new and improved method and apparatus for installing newel posts, which is quicker, requires no special tools and provides a more secure mounting which is also more aesthetic at the same time.

SUMMARY OF THE INVENTION

The present invention comprises a newel post fastening system which overcomes the foregoing and other difficulties associated with the prior art. In accordance with the invention, there is provided a method and apparatus for installing newel posts. The apparatus consists of a straight double-ended bolt having coarse lag threads at its lower end and screw threads at its upper end. The bolt is screwed into a hole drilled through the floor and into an underlying support, such as a floor joist, after which the upper end of the bolt is inserted into a longitudinal hole drilled into the lower end of the newel post. The longitudinal blind hole drilled into the lower end of the newel post intersects with the relatively larger transverse blind hole drilled therein a predetermined distance from the lower end of the newel post, within which a washer and nut can be secured over the upper end of the bolt and tightened to secure the newel post in place. A plug is then inserted to close the transverse hole in the newel post.

BRIEF DESCRIPTION OF DRAWINGS

A better understanding of the invention can be had by reference to the following Detailed Description in conjunction with the accompanying Drawing, wherein.

DETAILED DESCRIPTION

Figure 1:
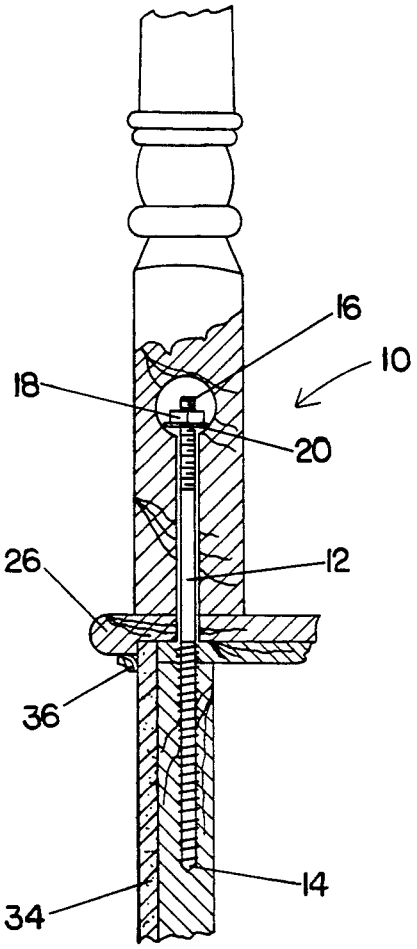
FIG. 1 is a partial vertical section view showing the newel post fastening system of the invention.

Referring now to the Drawing, wherein like reference numerals designate like or corresponding elements throughout the views, and particularly referring to FIG. 1, there is shown the newel post fastener 10 comprising the invention. As will be explained more fully hereinafter, the fastener 10 provides for quicker, more secure installation of the newel post in a railing without special tools, wood working techniques and skills, etc.

The newel post fastener 10 comprises a straight, double-ended bolt 12 having coarse lag threads 14 at its lower and screw threads 16 at its upper end. In accordance with the preferred construction, the overall length of bolt 12 is about 11" and it is about ½" in diameter. Bolt 12 is preferably formed of mild steel, such as grade 2 low carbon steel. The lag threads 14 extend inwardly about the half the length of bolt 12, while the screw threads 16 extend inwardly a relatively smaller portion of the length in order to provide a smooth shank therebetween. For example, in the preferred embodiment, the lag threads 14 extend inwardly about 5" to 6" and the screw threads 16 extend inwardly about 1" to 2" from their respective ends. A nut 18 and washer 20 are secured to the screw threads 16 on the upper end of bolt 12.

Figure 2:
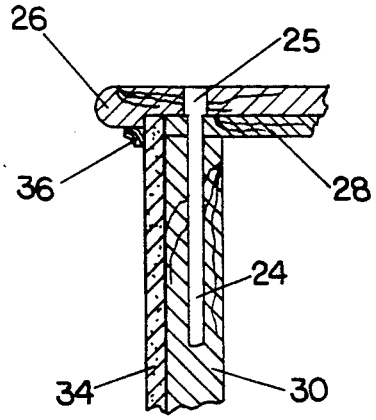
FIGS. 2 and 3 are partial sectional views showing installation of the bolt into the flooring.
Figure 3:
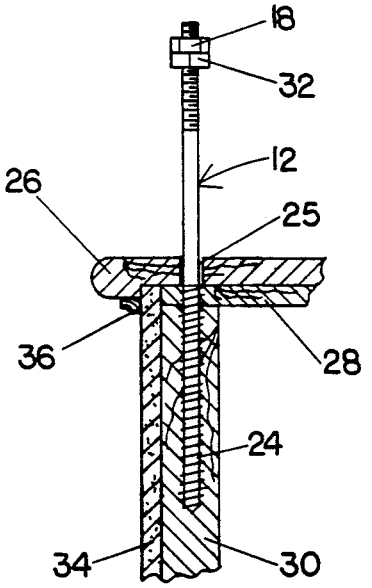
Figure 4:
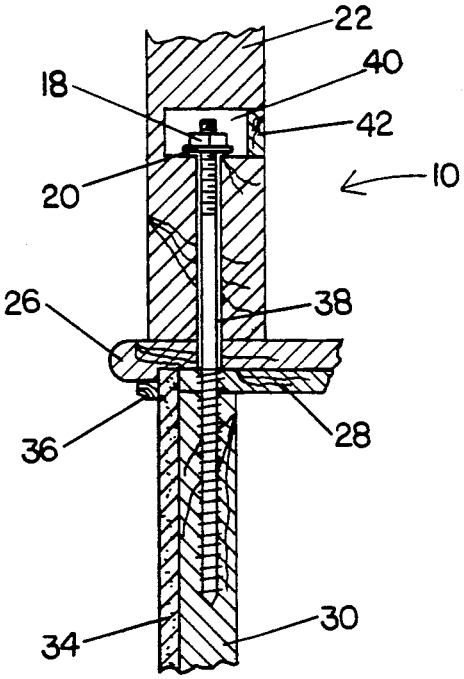
FIG. 4 is a partial sectional view, similar to FIG. 1 but turned 90 degrees, showing installation of the newel post over the bolt.

Referring now to FIGS. 2–4 in conjunction with FIG. 1, the fastener 10 is installed as follows. The bolt 12 must first be secured to the floor. After the location of the newel post 22 has been determined, a hole 24 is drilled downwardly at the center point through the landing nosing or finished floor 26, subfloor 28, and underlying support or floor joist 30. In the preferred embodiment, a ⅜th" drill bit would be used for drilling hole 24 downwardly to a depth of about 5". A ⅜th" drill bit preferably would be used to chase the hole 24 only as deep as any landing tread 26 or finished floor surface, as indicated by reference numeral 25 shown in FIG. 2. The bolt 12 is then screwed into the hole 24 using a wrench on nut 18 and a jam nut 32 as shown in FIG. 3.

After the bolt 12 has been secured to the floor, the nuts 18 and 32 are removed and the bolt 12 is plumbed by bending as necessary. Use of mild steel for bolt 12 facilitates any bending, not hammering, that may be necessary to plumb the bolt. Plaster board 34 and a trim strip 36 are shown in place on the outside of joist 30 underneath the stair tread 26.

The newel post 22 is then cut to length and holes 38 and 40 are drilled therein. As is best seen in FIG. 4, the holes 38 and 40 are blind longitudinal and transverse holes which are preferably ⅜th" and ½" in diameter in the preferred embodiment. The blind longitudinal hole 38 is preferably located at the centerpoint of post 22. The blind transverse hole 40 is preferably located about 5" from the lower end of the newel post 22.

After the holes 38 and 40 have been drilled, the newel post 22 is then placed over bolt 12 with the screw threads 16 at its upper end extending into the transverse hole. The nut 18 and washer 20 are then inserted into hole 40 and screwed onto the bolt 12 with a small box end wrench in order to tighten the newel post 22 downwardly.

A wood plug 42, which is preferably of the same wood as the newel post 22, is then inserted and glued in place, as last seen in FIG. 4. The plug 42 can then be sanded flat in order to close the transverse hole 40 and complete installation. In accordance with the preferred construction, the plug 42 is slightly tapered to assure a better fit.

Figure 5:
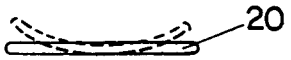
FIG. 5 is an enlarged view of the washer.

As the nut 18 is tightened downwardly onto the upper end of bolt 12, the washer 20 will become bowed. If desired, the washer 20 can be flat or dished as shown in phantom lines in FIG. 5.

From the foregoing, will thus be apparent that the present invention comprises an improved newel post fastening system having several advantages over the prior art. The apparatus of the invention is relatively simple and straight forward, and can readily be installed without special tools, woodworking skills or techniques, etc. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. Apparatus for fastening the lower end of a newel post to a floor, landing or stair tread, comprising:

a straight, double-ended bolt having coarse lag threads at one end and screw threads at the other end;

the coarse lag threads extending over a major portion of the length of said bolt;

said bolt being screwed downwardly by the coarse lag threads into the floor;

the other end of said bolt extending through a longitudinal hole in the lower end of the newel post and terminating within an intersecting transverse hole spaced inwardly from the lower end of the newel post;

a washer disposed within the transverse hold and over the other end of said of said bolt; and a nut screwed onto the screw threads on the other end of said bolt in order to hold down the newel post.

2. The apparatus of Claim 1, wherein said bolt is formed of mild steel.

3. The apparatus of Claim 1, wherein said bolt is about 11" long and about ½" in diameter.

4. The apparatus of Claim 1, wherein the coarse lag threads extend over about half the length of said bolt with the screw threads extending over a relatively shorter distance in order to provide a smooth shank therebetween.

5. The apparatus of Claim 1, further including:

a round plug for closing the transverse, hole in the newel post.

6. The apparatus according to Claim 5, wherein said plug is longitudinally tapered.

7. A kit for installing a newel post to a floor, landing or stair tread, comprising:

the newel post having a bottom end and opposite sides;

a straight, double-ended bolt having coarse lag threads at one end and screw threads at the other end;

the coarse lag threads extending over a major portion of the length of said bolt, with the screw threads extending over a relatively shorter distance in order to provide a smooth shank therebetween;

said bolt being screwed downwardly by the course lag threads into the floor;

the other end of said bolt for passing through a longitudinal hole in the bottom end of the newel post and terminating within an intersecting transverse hole in the side of the newel post spaced inwardly from the bottom end of the newel post;

a washer for insertion into the transverse hole and placement over the other end of said bolt;

a nut for insertion into the transverse hole and engagement onto the screw threads on the other end of said bolt in order to hold down the newel post; and a plug for closing the transverse hole in the newel post and concealing said nut and washer therein.

8. The kit of claim 7, wherein said bolt is formed of mild steel.

9. The kit of claim 7, wherein said bolt is about 11" long and about ½" in diameter.

10. The kit of claim 7, wherein the coarse lag threads extend over about half the length of said bolt with the screw threads extending over a relatively shorter distance in order to provide a smooth shank therebetween.

11. The kit of claim 7, wherein said plug is longitudinally tapered.

12. A kit for installing a newel post to a floor, landing or stair tread, comprising:

the newel post having a bottom end and opposite sides;

a straight, double-ended bolt having coarse lag threads at one end and screw threads at the other end;

the coarse lag threads extending over a major portion of the length of said bolt, with the screw threads extending over a relatively shorter distance in order to provide a smooth shank therebetween;

said bolt being screwed downwardly by the coarse lag threads into the floor;

the other end of said bolt for passing through a longitudinal hold in the bottom end of the newel post and terminating within an intersecting transverse hole in the side of the newel post spaced inwardly from the bottom end of the newel post;

a washer for insertion into the transverse hole and placement over the other end of said bolt; and a nut for insertion into the transverse hole and engagement onto the screw threads on the other end of said bolt in order to hold down the newel post.

13. The kit of claim 12, wherein said bolt is formed of mild steel.

14. The kit according to claim 13, wherein the coarse lag threads extend over about half the length of said bolt with the screw threads extending over a relatively shorter distance in order to provide a smooth shank therebetween.

15. The kit according to claim 14, further including:

a round plug for closing the transverse hole in the newel post.

* * * * *

UNITED STATES PATENT AND TRADEMARK OFFICE

CERTIFICATE OF CORRECTION

PATENT NO. : 5,095,668
APPLICATION NO. : 07/605407
DATED : March 17, 1992
INVENTOR(S) : Daniel K. O'Brien et al.

It is certified that error appears in the above-identified patent and that said Letters Patent is hereby corrected as shown below:

Column 3, line 1, change "last" to --best--.
Column 3, line 43, change "hold" to --hole--.
Column 4, line 8, change "course" to --coarse--.
Column 4, line 47, change "hold" to --hole--.

Signed and Sealed this

Fifth Day of June, 2007

JON W. DUDAS
*Director of the United States Patent and Trademark Office*